US010492586B2

(12) United States Patent
Paquet

(10) Patent No.: US 10,492,586 B2
(45) Date of Patent: Dec. 3, 2019

(54) MATERIAL DISPENSER/APPLICATOR

(71) Applicant: Intel Plastics Inc., Toronto (CA)

(72) Inventor: Ken Paquet, Toronto (CA)

(73) Assignee: Intel Plastics Inc., Toronto, Ontario (CA)

( * ) Notice: Subject to any disclaimer, the term of this patent is extended or adjusted under 35 U.S.C. 154(b) by 22 days.

(21) Appl. No.: 15/932,557

(22) Filed: Mar. 14, 2018

(65) Prior Publication Data

US 2019/0281953 A1 Sep. 19, 2019

(51) Int. Cl.

| | |
|---|---|
| ***B43K 23/00*** | (2006.01) |
| ***A45D 40/14*** | (2006.01) |
| ***A45D 40/02*** | (2006.01) |
| ***A45D 40/26*** | (2006.01) |
| ***A45D 40/10*** | (2006.01) |
| ***A45D 40/12*** | (2006.01) |
| *A45D 40/16* | (2006.01) |
| *A45D 40/20* | (2006.01) |

(52) U.S. Cl.

CPC ..... *A45D 40/14* (2013.01); *A45D 40/02* (2013.01); *A45D 40/10* (2013.01); *A45D 40/12* (2013.01); *A45D 40/264* (2013.01); *A45D 40/16* (2013.01); *A45D 2040/105* (2013.01); *A45D 2040/207* (2013.01)

(58) Field of Classification Search

CPC ..... A45D 40/02; A45D 40/10; A45D 40/12; A45D 40/14; A45D 40/16; A45D 40/264; A45D 2040/105; A45D 2040/207

See application file for complete search history.

(56) References Cited

U.S. PATENT DOCUMENTS

| | | | | |
|---|---|---|---|---|
| 4,139,311 | A | 2/1979 | Lorscheidt | |
| 4,580,920 | A * | 4/1986 | Schmidt | A45D 40/04 132/318 |
| 5,799,667 | A | 9/1998 | Szekely | |
| 5,984,553 | A | 11/1999 | Oisicopo et al. | |
| 7,086,796 | B2 * | 8/2006 | Severa | A45D 34/04 401/179 |
| 2014/0103071 | A1 | 4/2014 | Park et al. | |

FOREIGN PATENT DOCUMENTS

| | | | |
|---|---|---|---|
| WO | WO2005/084821 | A1 | 9/2005 |
| WO | WO2015/177669 | A1 | 11/2015 |

* cited by examiner

*Primary Examiner* — Jennifer C Chiang

(57) ABSTRACT

An applicator for a semi-solid material (e.g. lip balm) with an elastomeric material base cap has an interior tube long enough to cooperate with other structures to allow ejection of the plunger associated with the lip balm and its shaft by continued depression of the base cap. This allows easy replacement of the lip balm in the applicator when the original is used up. The applicator also has a tubular housing with interior guide hub with ribs configured and positioned to preclude spinning of the shaft of the plunger mounting the lip balm. A dispenser for flowable material (such as lotion) comprises a bellows mounted in a housing with an elastomeric material base cap at one end, and an end cap at the other end with a first part connected to the housing by screw threads, and a second part connected to the first part by a living hinge.

20 Claims, 7 Drawing Sheets

MATERIAL DISPENSER/APPLICATOR

CROSS REFERENCE TO RELATED APPLICATION

This application is based upon, and claims the priority of, U.S. Provisional Application Ser. 62/285,570 filed Nov. 2, 2015, the disclosure of which is hereby incorporated by reference herein; and this application is the U S National Phase of PCT/US2016/00089 filed Oct. 27, 2016.

BACKGROUND AND SUMMARY OF THE INVENTION

The disclosure of PCT/IB2015/053286 (now U S National Phase application Ser. No. 15/330,500 filed Sep. 28, 2016, Publication No. US 2017-0007003A1) is hereby incorporated by reference herein. That application relates to an applicator for semi-solid materials, such as lip balm, that incorporates many novel features including, but not limited to, an elastomeric material base cap, and a plunger for holding the semi-solid material, which plunger is reciprocal within and with respect to a housing.

According to the present invention, a number of additional features and/or enhanced functionalities are provided for a material dispenser/applicator, based at least in part on the applicator of said application Ser. No. 15/330,500. Also, a novel flowable material dispenser is disclosed.

According to one aspect of the present invention there is provided an applicator for a semi-solid material such as lip balm. The applicator comprises: A generally tubular housing having first and second ends. A plunger to which is mounted semi-solid material extending exteriorly of the housing first end, the plunger including a shaft. And an elastomeric material base cap mounted to the second end of the housing and having an interior structure to which the shaft is connected. The structures are configured so that by continued depression the elastomeric base cap is movable to a position which induces separation between surface manifestations on the shaft and interior structure of the base cap which provides ejection of the plunger and its shaft from the housing.

The elastomeric base cap interior structure to which the shaft is connected preferably comprises a tubular portion of the base cap. An end cap (preferably transparent or translucent) is releasably connected to the housing at the first end thereof for covering the semi-solid material. In view of the desired functionality of the applicator of the invention the elastomeric base cap should have a durometer of about 45-55 (about 50 is ideal) on the Shore A scale, not the broader range of 40-70 in said application Ser. No. 15/330,500.

The applicator preferably further comprises an apertured abutment within the housing through which the plunger shaft reciprocates and which acts as a stop for the interior structure of the base cap during ejection of the plunger shaft from the housing. The housing desirably has an interior guide hub (or apertured abutment) with ribs configured and positioned to preclude spinning of the plunger shaft.

In one embodiment of the invention the elastomeric material base cap is a bistable element which moves from a first stable configuration in which the semi-solid material is primarily within the housing to, after removal of the end cap and manual actuation thereof a second stable configuration in which the semi-solid mass is substantially completely exterior of the housing, and upon further manual actuation of the elastomeric material base cap while in the second stable configuration moves to a third position whereby the plunger shaft is ejected from contact with the elastomeric base cap. In another embodiment the base cap merely moves from its normal position to the eject position, and is not bistable.

According to another aspect of the invention, an applicator for a semi-solid material is provided which comprises: A generally tubular housing having first and second ends. A plunger to which is mounted semi-solid material extending exteriorly of the housing first end, the plunger including a shaft. And an interior guide hub with ribs configured and positioned to preclude spinning of the plunger shaft. The particular elastomeric material end cap as described above may also be utilized.

According to another aspect of the invention there is provided a method of using the applicator as described above to eject a plunger having semi-solid material which is primarily used up, and replacing it with another, replacement, plunger having a fresh supply of semi-solid material by inserting the shaft of the replacement plunger into operative association with the interior structure/tube of the elastomeric material end cap.

According to yet another aspect of the invention there is provided a dispenser for dispensable material which comprises: A generally tubular housing having first and second ends. A dispensable material containing or supporting structure including a shaft having a first surface manifestation thereon; an elastomeric material base cap at the second end of the housing and having a generally central structure with a second surface manifestation releasably operatively cooperating with the first surface manifestation. Upon depression thereof, the elastomeric material base cap operatively moves to a position which moves the shaft to provide access to dispensable material from the dispensable material containing or supporting structure at the first end of the housing. And a stop mechanism within the housing for stopping movement of the generally central structure of the base cap so that upon continued depression of the base cap the first and second surface manifestations disconnect so that said dispensable material containing or supporting structure is removable from the housing and replaceable by a fresh dispensable material containing or supporting structure.

The dispensable material containing structure may comprise a bellows containing flowable material mounted within the housing and having a dispensing nozzle adjacent the first end of the housing. The dispenser also preferably includes an end cap for releasably closing the first end of the housing through which the flowable material is dispensed by the dispensing nozzle. The end cap preferably includes a first portion which screws onto the housing, and a second potion which is connected by a living hinge to the first portion and which pivots to uncover, and cover, the dispensing nozzle.

It is the primary object of the present invention to provide an applicator or dispenser with readily replaceable material application or dispensing components. This and other objects of the invention will become clear from a detailed description of the invention and from the appended claims.

DETAILED DESCRIPTION OF THE DRAWINGS

Figure 1:
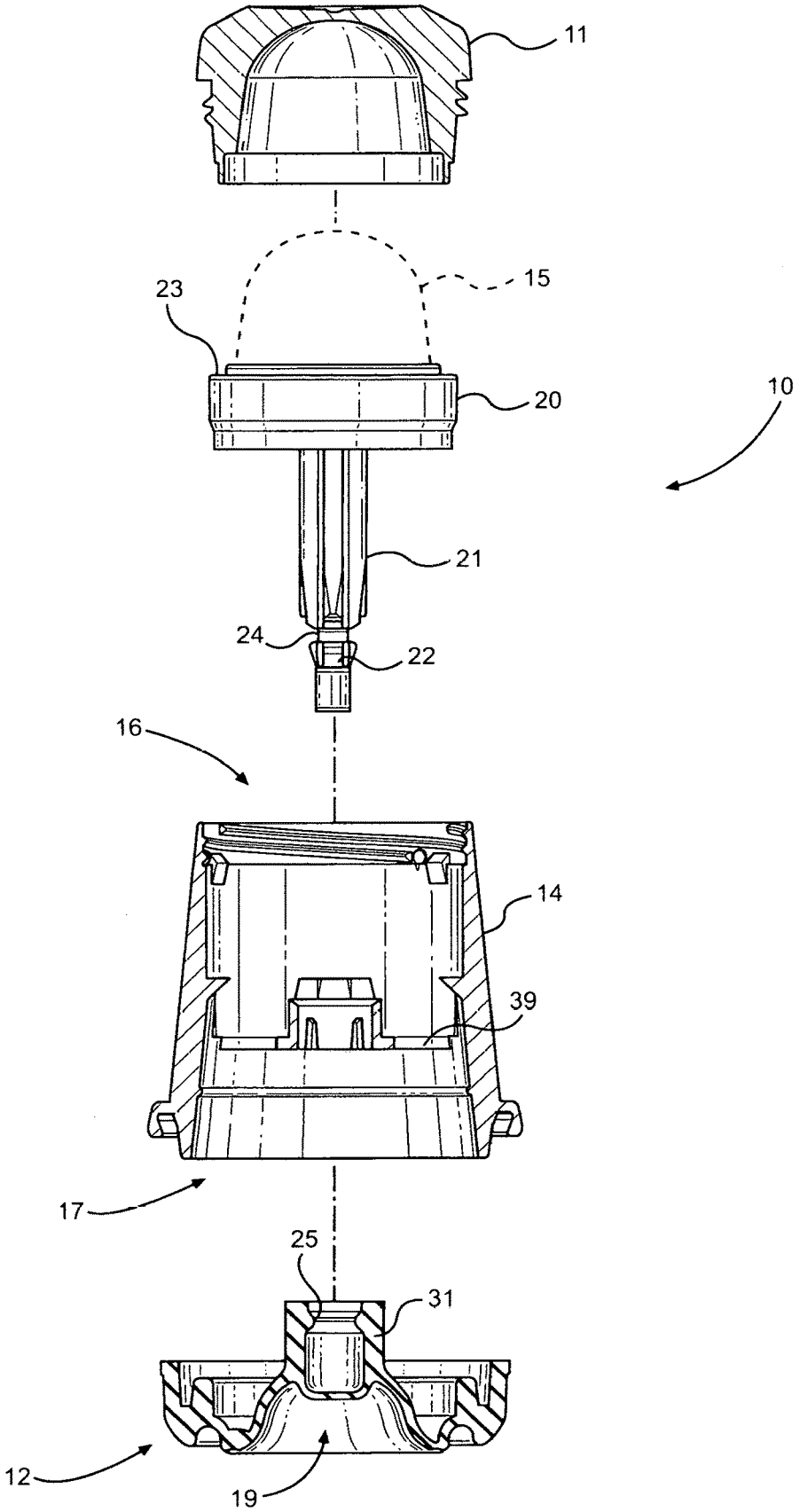
FIG. 1 is an exploded side cross-sectional view of a semi-solid material (the material, such as lip balm or lipstick, itself shown in dotted line) applicator according to the invention with what may be called an "ejection button" which allows the plunger shaft to be readily detached from the elastomeric material base cap to allow ready replacement of cartridges of semi-solid material (as disclosed per se in application Ser. No. 15/330,500)

The applicator 10 according to the invention in FIGS. 1-4 is very similar to the applicator in said application Ser. No. 15/330,500, including a screw-on end cap 11, an elastomeric material base cap 12, a tubular housing 14, and a reciprocal plunger 20 which mounts a semi-solid material (such as lip balm, shown in dotted line at 15) which has a plunger shaft 21. The housing 14 has a first end 16 and an opposite second end 17. The components may be made of the same materials as in said application Ser. No. 15/330,500.

In the FIGS. 1-4 applicator 10, the central tube 31 (comparable to the central tubes 31, 131 in said application Ser. No. 15/330,500) which releasably connects the base cap 12 to the end 22 of the plunger shaft 21 opposite the semi-solid material 15 is longer than that in the application Ser. No. 15/330,500. In one practical embodiment the central tube 31 is about 2-3 mm (e.g. about 2.5 mm) longer. This added length allows the applicator to function so that the plunger 20 and shaft 21 may be "ejected" from the housing 14, allowing ready use of replacement cartridges once all of the semi-solid material 15 has been used up.

Figure 4:
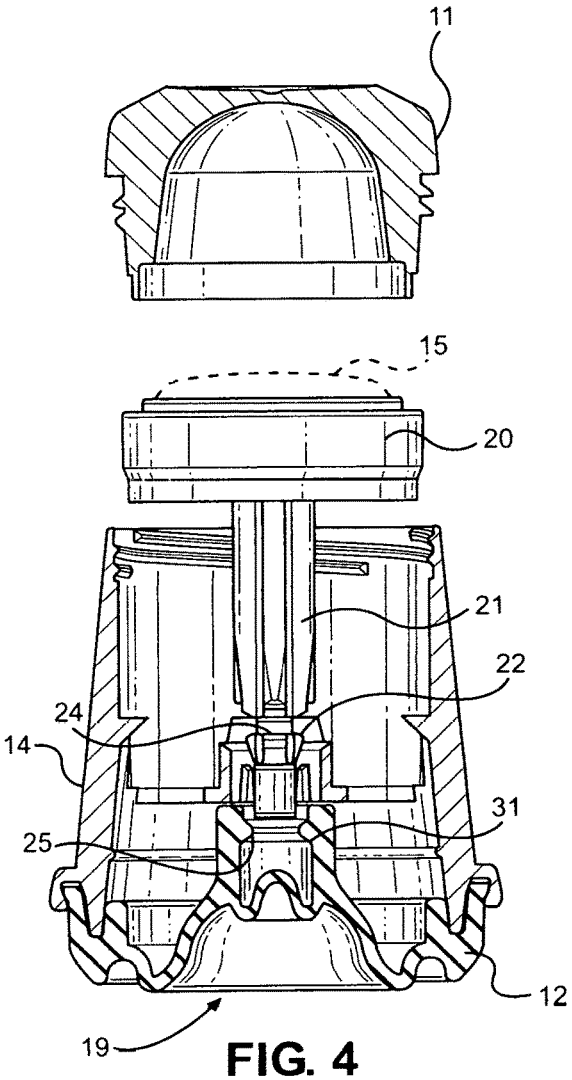
FIG. 4 is a view like that of FIG. 3 only with the semi-solid material shown as substantially depleted, and showing the ejector button on the base cap depressed further from the second position to a third position so that the elastomeric material end cap is detached from the plunger shaft so that a new plunger, with a fresh quantity of semi-solid material, may be inserted into operative association with the elastomeric material end cap.

The end 22 of the plunger shaft 21 has a first surface manifestation—in the drawing shown at 24 as a circumferential depression in the end 22 of shaft 21—which operatively cooperates with a second surface manifestation 25 on the tube 31, element 25 best seen in FIGS. 1 & 4. The second surface manifestation 25 is in the form of a circumferential projection which fits in the depression 24 to hold the elements 21, 31 together during normal operation, and until separation thereof is desired. While the manifestations 24, 25 as illustrated are preferred any other surface manifestations that perform the intended function of releasably attaching the shaft 21 to the base cap 12 may be provided.

Also, in the applicator 10 according to the invention it has been found that the elastomeric material of the base cap 12 should have a durometer of about 45-55 (about 50 is highly desirable) on the Shore A scale, rather than 40-70 as in the application Ser. No. 15/330,500. A durometer of about 50 allows the base cap 12 to still be bistable yet effectively be moved to a third, eject, position, during which the surface manifestations 24, 25 detach.

Figure 2:
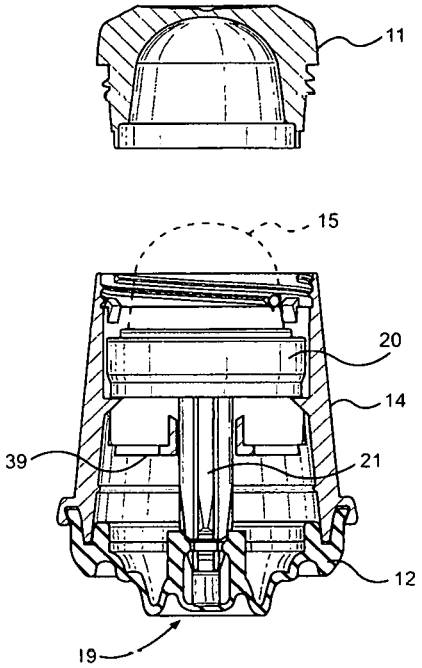
FIG. 2 is a side cross-sectional view of the applicator of FIG. 1 assembled, except for the end cap which has been unscrewed from the housing, with the components in a first position wherein much of the semi-solid material is within the housing.

Once the end cap 11 is removed (preferably by unscrewing it, as in FIGS. 1-4), the semi-solid material 15 associated with the plunger 20 is exposed but typically much of it does not extend out the first end 16 of the housing 14, as seen in FIG. 2. A human user can use her/his finger to engage the exterior surface 19 (which may be considered an eject button) of the base cap 12 and push it from the first stable position shown in FIG. 2 to a second stable position shown in FIG. 3 in which substantially all of the material 15 is exterior of the first end of the housing 14. That is, as in said application Ser. No. 15/330,500, the cap 12 is bistable.

Figure 3:
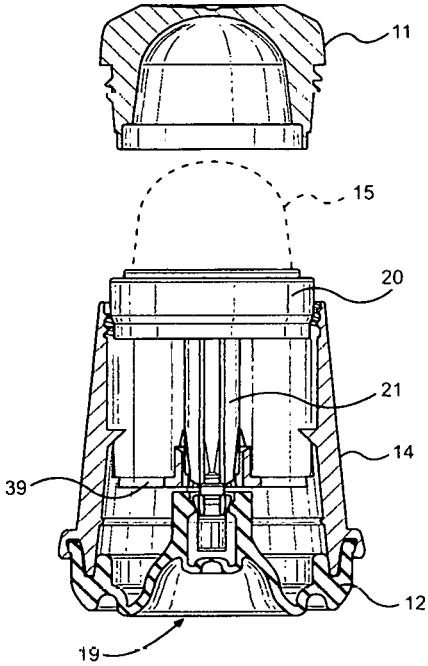
FIG. 3 is a view like that of FIG. 2 wherein the bistable base cap has been moved to a second position in which the semi-solid material is substantially completely exterior of the housing.

During movement of base cap 12 from the first position of FIG. 2 to the second position of FIG. 3 the plunger shaft 21 is guided by the centrally located guide hub 39, which can also be considered an apertured abutment. In the position of the base cap 12 in FIG. 3 the central tube 31 engages the centrally located guide hub 39 which guides reciprocation of the shaft 21, stopping movement of the tube 31.

If depression of base cap 12 by a user's finger is continued from the position of FIG. 3 to the position of FIG. 4 then the plunger shaft 21 end 22 will be detached from the base cap 12 tube 31 because the plunger shaft 21 will keep moving but the base cap 12 will be stopped by the hub 39. Therefore the shaft 21 and plunger 20 attached thereto, as in FIG. 4, will be separated from the rest of the applicator 10 since the surface manifestations 24, 25 will be detached from one another so that a new cartridge containing a new plunger 20 with fresh semi-solid material 15 attached, and plunger shaft 21, may replace the removed one by inserting the new shaft end 22 into the central tube 31 when the base cap 12 is in the FIG. 4 position. When the replacement plunger is inserted the elastomeric tube 31 of the elastomeric material base cap 12 is deflected so that the surface manifestations 24, 25 engage each other and the new shaft 21 is attached to the base cap 12.

It is noted that during the ejection process, that is moving from the second position of FIG. 3 to the third, eject, position of FIG. 4, typically the first end 16 of the housing 14 will be angled (or completely facing) downwardly so that gravity assists in the detachment of the old plunger 20 from the base cap 12.

During insertion of the new plunger with fresh lip balm or the like 15 desirably the user will hold the base cap 12 in the FIG. 4 position while the user (preferably but not necessarily with the end cap 11 over the material 15 but engaging the circumferential periphery 23 of the top of the plunger 20 and not the material 15 itself) pushes the end 22 of shaft 21 into operative association with the central tube 31 of the base cap 12. Once the shaft end 22 is seated, the user removes her/his finger from the exterior 19 of the base cap 12, and continues to move the end cap 11 toward the housing 14, and ultimately screws it in place so that the end cap 12 and plunger 20 are in the positions illustrated in FIG. 2.

Figure 5:
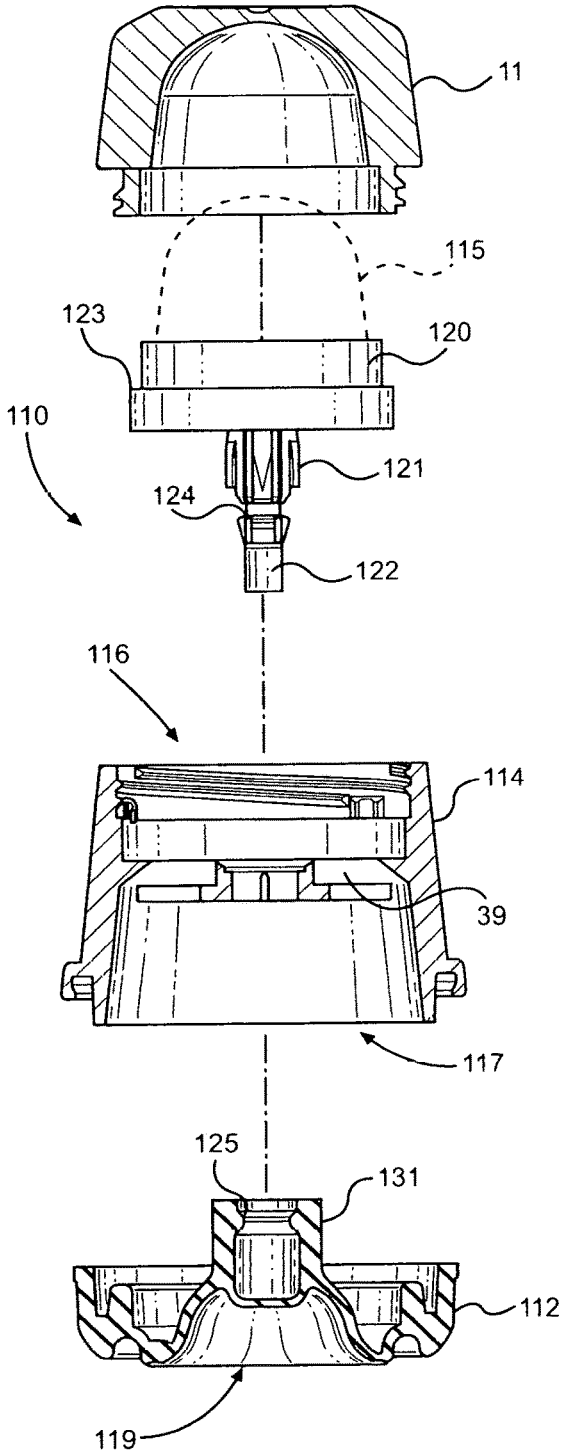
FIG. 5 is a view like that of FIG. 1 of a second configuration of applicator according to the invention which has a shorter housing and wherein the elastomeric material base cap is not bistable.
Figure 6:
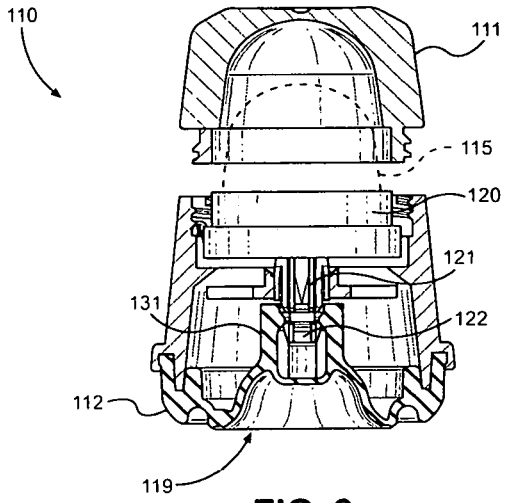
FIG. 6 is a view like that of FIG. 2 for the second configuration of applicator.
Figure 7:
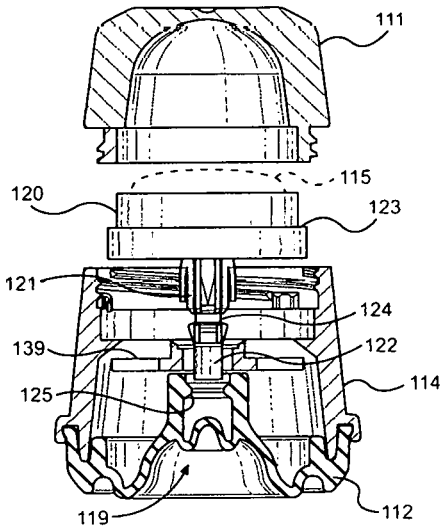
FIG. 7 is a view like that of FIG. 4 for the second configuration of applicator.

The applicator 110 of FIGS. 5-7 is similar to that of FIGS. 1-4 only the housing 114 and shaft 121 are shorter and the end cap 112 is not bistable. Components comparable to those of the FIGS. 1-4 embodiment are shown by the same reference numeral only preceded by a "1."

In FIG. 6 the base cap 112 is in its normal position (once the end cap 111 is removed) with the lip balm 115 extending outwardly from the first end 116 of the housing 114. Once the lip balm 115 has been substantially depleted (as shown schematically in FIG. 7) the user pushes on exterior surface 119 of the base cap 112 to move it to the eject position. During this sequence to the position illustrated in FIG. 7 the surface manifestations 124, 125, respectively, on the end 122 of shaft 121 and central tube 131 of base cap 112, respectively, detach from each other since the tube 131 movement is stopped by the apertured abutment 139. Replacement of a new plunger 120 with fresh material 115 is as described above with respect to the FIGS. 1-4 embodiment.

Figure 8:
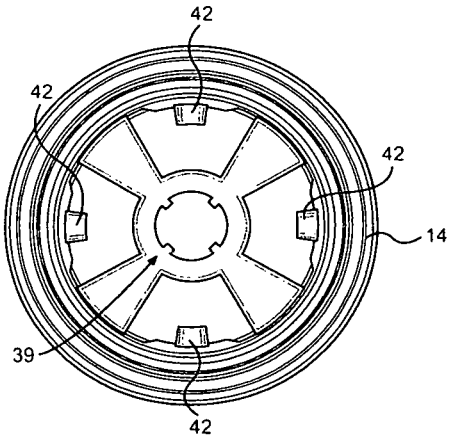
FIG. 8 is a bottom view of an exemplary housing for the applicator of FIGS. 1-4.
Figure 9:
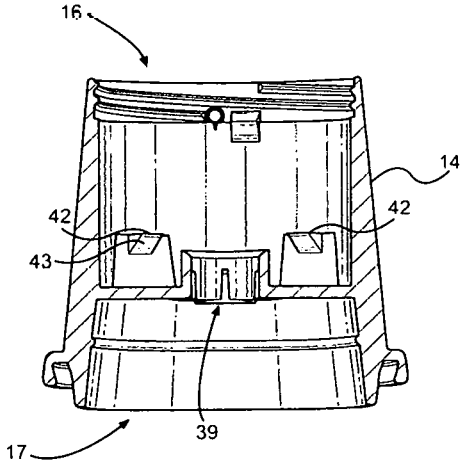
FIG. 9 is a side cross-sectional view of the housing of FIGS. 1-4 & 8 rotated ninety degrees from the view in FIG. 1.
Figure 10:
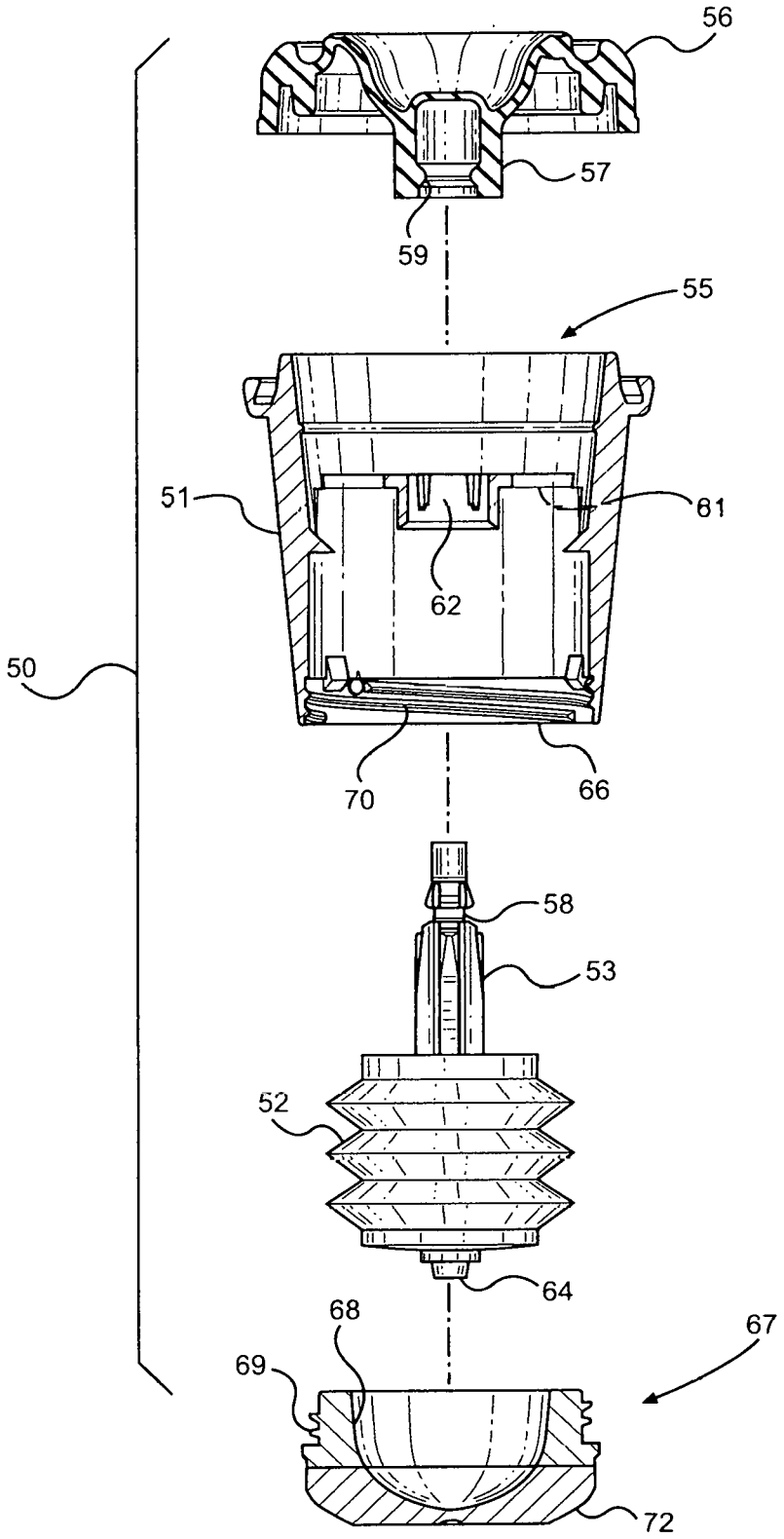
FIG. 10 is a side cross-sectional exploded view of a flowable material dispenser using an elastomeric base cap and housing similar to those of the embodiments in the other FIGURES and said application Ser. No. 15/330,500 but with an internal bellows with associated shaft, shown in elevation, the bellows containing the flowable material instead of a plunger mounting a mass of semi-solid material.

Preferably, as shown most clearly in FIGS. 8 & 9, the housing 14, includes interior ribs 42 associated with the guide hub/apertured abutment 39 to prevent the plunger shaft 21 from spinning; otherwise spinning might occur, such as when a seal (if it exists) between the semi-solid material 15 and the end cap 11 is broken when the end cap 11 is unscrewed from the housing 14 first end 16. The ribs 42 engage portions of the perimeter of the plunger (which may have the configuration of the plunger 121 illustrated in FIG. 7 of said PCT application) to prevent it from spinning/rotating.

The housing 114 may have ribs 42 also, as described above, the housing 114 substantially the same as housing 14 except that it is shorter.

FIGS. 8 and 9 show four ribs 42 symmetrically positioned around the interior circumference of the circular opening in the guide hub 39 and show the "upper" (closest to the base cap) faces 43 thereof slanted downwardly in FIG. 9 (so that the ribs 42 themselves have a generally triangular cross-section). However other numbers (e.g. three or five) and/or configurations in cross-section (e.g. quadrate, multiple, or random) may be provided.

FIGS. 10-13 show a different type of material dispenser 50 than in the other FIGURES but using the same general concepts of a tubular housing, an end cap, and an elastomeric material base cap. Different numerals will be used than related to the other FIGURES.

The dispenser 50 is provided for dispensing a flowable material (e.g. liquid), such as (but not limited to) lotions, eye drops or other medical or medicinal fluids, flavor concentrates for flavoring ingestible liquids like water, toothpaste, and lubricants. Located interiorly of a generally tubular housing 51 is a bellows 52 made of generally conventional bellows elastomeric material, operatively connected at a closed end thereof through a connected (preferably integral) shaft 53 to a central interior tube 57 of an elastomeric base cap 56 at the second end 55 of the housing 51. The base cap 56 preferably has a central tube 57 just like the tubes 31, 131 in the other embodiments, and the first surface manifestation 58 on the shaft 53 and the second surface manifestation 59 in the tube 57 are just like the surface manifestations 24, 124, 25, 125 in the other embodiments.

Interior of the housing 51 is an interior guide hub/apertured abutment 61 with an interior opening 62 defined by a collar which guides reciprocation of the shaft 53.

The end of the bellows 52 opposite the shaft 53 has a conventional dispensing nozzle 64 therein, which will be dimensioned depending upon the particular flowable material to be dispensed and which may include a conventional one-way valve.

The first end 66 of the housing 51, opposite the elastomeric base cap 56, may be closed off by an end cap 67. In the preferred embodiment illustrated in FIGS. 10-13 the end cap 67 contains a hollow generally tubular first portion 68 which has external screw threads 69 (best seen in FIGS. 10 & 13) which screw onto conventional complementary interior screw threads 70 (FIG. 10) on the first end 66 of the housing 51. The end cap 67 also includes a solid terminating second portion 72 which is connected by a living hinge 73 (FIGS. 11 & 12) to the first portion 68. Any suitable closure (such as a clip, magnet, snap, etc.) may be provided for holding the second portion 72 to the first portion 68 when the dispenser 50 is in the non-dispensing position with the elements 68, 72 connected as in FIGS. 10 & 13.

Figure 11:
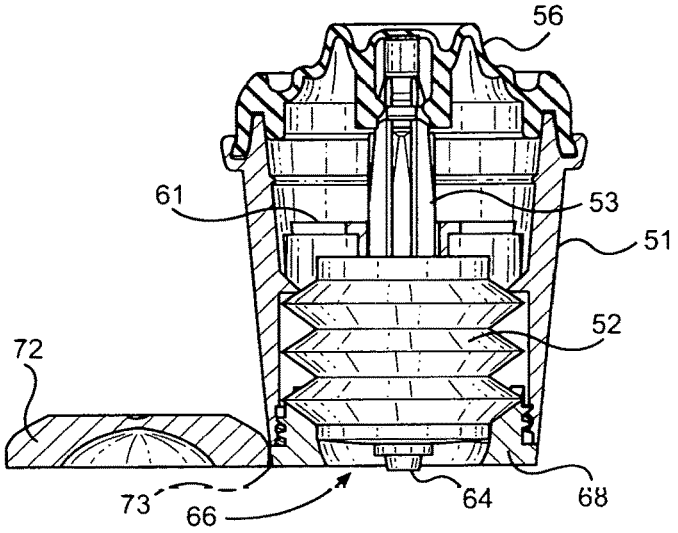
FIG. 11 is a side cross-sectional view of the dispenser of FIG. 10 assembled and with the end cap open to allow dispensing of flowable material.
Figure 12:
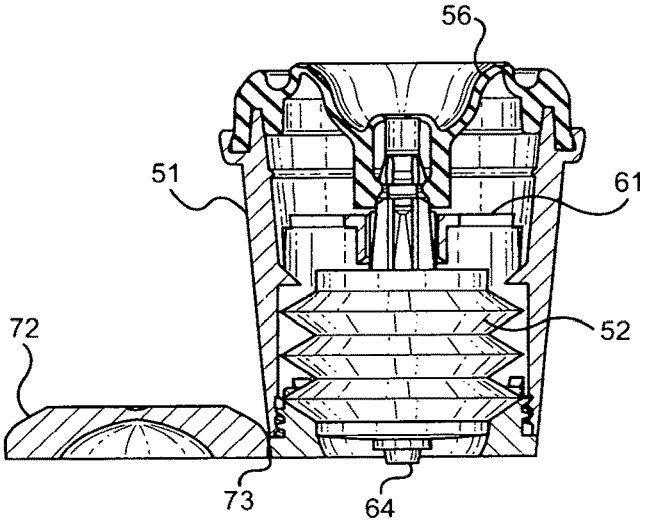
FIG. 12 is a view like that of FIG. 11 with the base cap slightly depressed to dispense flowable material from the bellows.
Figure 13:
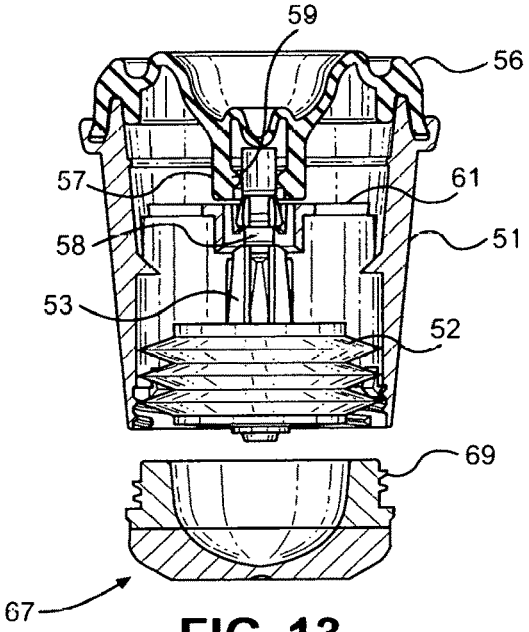
FIG. 13 is a view like that of FIG. 12 only showing the end cap completely removed, the bellows depleted, and the base cap moved to a position whereby the bellows shaft is detached from the base cap so that the bellows and shaft may be ejected and replaced by a replacement fresh bellows and shaft.

In operation of the dispenser 50, the end cap 67 second portion 72 is detached from the first portion 68, and pivoted away via the living hinge 73 to the relative positions illustrated in FIGS. 11 & 12. To dispense the flowable material within the bellows 52 the user depresses the elastomeric material base cap 56, causing the bellows 52 to compress and the flowable material therein to be dispensed through the nozzle 64. FIG. 11 shows the dispenser 50 in a position just before depression of the elastomeric material base cap 56 and FIG. 12 shows the bellows 52 partially compressed in response to depression of the base cap 56.

Once the bellows 52 is substantially empty the end cap 67 is unscrewed (FIG. 13) from the housing 51. Then depression of the end cap 56 is continued to the position of FIG. 13 wherein movement of the tube 57 is stopped by the abutment 61. This causes detachment of the surface manifestations 58, 59 so that the shaft 53 and bellows 52 are easily removed from the housing 51 just as for the other embodiments in FIGS. 4 & 7. A new bellows 52 can be inserted, the shaft 53 thereof moved into operative engagement with the central interior tube 57 of the base cap 56 so that the surface manifestations 58, 59 operatively engage so that the base cap 56 is operatively connected to the new bellows 52.

The entire dispenser 50 is preferably made of dishwasher safe and eco-friendly plastic.

It will thus be seen that there are generic similarities between the various embodiments, comprising in general a dispenser for dispensable material (a semi-solid like lip balm or a flowable material like lotion) having a dispensable material containing or supporting structure (20, 52) including a shaft (21, 53) having a first surface manifestation thereon (24, 58); an elastomeric material base cap (12, 56) having a generally central structure (31, 57) with a second surface manifestation (25, 59) releasably operatively cooperating with the first surface manifestation (24, 58); upon depression thereof, the elastomeric material base cap (12, 56) operatively moves to a position which moves the shaft (21, 53) to provide access to dispensable material from the dispensable material containing or supporting structure (20, 52) at the first end (16, 70) of the housing (14, 51); and a stop mechanism (39) within the housing (14, 51) for stopping movement of the generally central structure (31, 57) of the base cap so that upon continued depression of the base cap the first and second surface manifestations (24, 25; 58, 59) disconnect so that the dispensable material containing or supporting structure (20, 52) is removable from the housing (14, 51) and replaceable by a fresh dispensable material containing or supporting structure.

The invention is to accorded the broadest scope possible of the appended claims to encompass all equivalent structures, devices, and procedures, limited only by the prior art. Also all narrow ranges of parameters within any broad range are also specifically provided herein.

What is claimed is:

1. An applicator for a semi-solid material comprising: a generally tubular housing having first and second ends; a plunger to which semi-solid material is mounted extending exteriorly of said housing first end, said plunger including a shaft with a first surface manifestation; an elastomeric material base cap mounted to said second end of said housing and having an interior structure comprising a second surface manifestation releasably engaging said first surface manifestation so that by continued depression of said base cap said elastomeric base cap is movable to a position which disengages said first and second surface manifestations which then allows ejection of the plunger and its shaft from said housing.

2. An applicator as recited in claim 1 wherein said elastomeric base cap interior structure to which said shaft is connected comprises a tubular portion of said base cap.

3. An applicator as recited in claim 1 further comprising an end cap releasably connected to said housing at said first end thereof for covering said semi-solid material.

4. An applicator as recited in claim 1 wherein said elastomeric base cap has a durometer of about 45-55 on the Shore A scale.

5. An applicator as recited in claim 1 further comprising an apertured abutment within said housing through which said plunger shaft reciprocates and which acts as a stop for said interior structure of said base cap during ejection of said plunger shaft from said housing.

6. An applicator as recited in claim 1 wherein said elastomeric material base cap is a bistable element which moves from a first stable configuration in which said semi-solid material is primarily within said housing to, after removal of said end cap and manual actuation thereof, a second stable configuration in which said semi-solid mass is substantially completely exterior of said housing, and upon further manual actuation of said elastomeric material base cap while in said second stable configuration moves to a third position whereby said plunger shaft is ejected from contact with said elastomeric base cap.

7. An applicator as recited in claim 1 wherein said housing has an interior guide hub with ribs configured and positioned to preclude spinning of said plunger shaft.

8. An applicator as recited in claim 1 wherein said semi-solid material is lip balm and wherein said end cap is transparent or translucent.

9. An applicator as recited in claim 3 further comprising an apertured abutment within said housing through which said plunger shaft reciprocates and which acts as a stop for said interior structure of said base cap during ejection of said plunger shaft from said housing.

10. An applicator as recited in claim 3 wherein said elastomeric material base cap is a bistable element which moves from a first stable configuration in which said semi-solid material is primarily within said housing to, after removal of said end cap and manual actuation thereof, a second stable configuration in which said semi-solid mass is substantially completely exterior of said housing, and upon further manual actuation of said elastomeric material base cap while in said second stable configuration moves to a third position whereby said plunger shaft is ejected from contact with said elastomeric base cap.

11. An applicator as recited in claim 3 wherein said housing has an interior guide hub with ribs configured and positioned to preclude spinning of said plunger shaft.

12. An applicator as recited in claim 10 wherein said elastomeric base cap has a durometer of about 45-55 on the Shore A scale.

13. An applicator for a semi-solid material comprising: a generally tubular housing having first and second ends; a plunger to which is mounted semi-solid material extending exteriorly of said housing first end, said plunger including a shaft; and an interior guide hub cooperating with a plurality of spaced ribs configured and positioned to preclude spinning of said plunger shaft.

14. An applicator as recited in claim 13 further comprising an elastomeric material base cap mounted to said second end of said housing and having an interior tube to which said shaft is connected; by continued depression of said base cap said elastomeric base cap interior tube is precluded from movement by said interior guide hub which allows ejection of the plunger and its shaft from said housing and whereby a new plunger shaft can be moved through said guide hub into operative association with said interior tube.

15. An applicator as recited in claim 14 wherein said elastomeric base cap has a durometer of about 45-55 on the Shore A scale.

16. A method of using the applicator of claim 1 to eject a plunger having semi-solid material which is primarily used up, and replacing it with another replacement plunger having a fresh supply of semi-solid material by inserting the shaft of the replacement plunger into operative association with the interior structure of the elastomeric material end cap.

17. A dispenser for dispensable material comprising: a generally tubular housing having first and second ends; a dispensable material containing or supporting structure including a shaft having a first surface manifestation thereon; an elastomeric material base cap at said second end of said housing and having a generally central structure with a second surface manifestation releasably operatively cooperating with said first surface manifestation; upon depression thereof, said elastomeric material base cap operatively movable to a position which moves said shaft to provide access to dispensable material from said dispensable material containing or supporting structure at said first end of said housing; and a stop mechanism within said housing for stopping movement of said generally central structure of said base cap so that upon continued depression of said base cap said first and second surface manifestations disconnect so that said dispensable material containing or supporting structure is removable from said housing and replaceable by a fresh dispensable material containing or supporting structure.

18. A dispenser as recited in claim 17 wherein said dispensable material containing structure comprises a bellows containing flowable material mounted within said housing and having a dispensing nozzle adjacent said first end of said housing; and an end cap for releasably closing said first end of the housing through which the flowable material is dispensed by said dispensing nozzle.

19. A dispenser as recited in claim 18 wherein said end cap includes a first portion which screws onto said housing, and a second potion which is connected by a living hinge to said first portion and which pivots to uncover, and cover, said dispensing nozzle.

20. A dispenser as recited in claim 18 wherein said flowing material within said bellows is selected from the group consisting essentially of lotion, eye drops, flavor concentrates for flavoring ingestible liquids, toothpaste, and lubricants.

* * * * *